US008332219B2

(12) United States Patent
Lin et al.

(10) Patent No.: US 8,332,219 B2
(45) Date of Patent: Dec. 11, 2012

(54) SPEECH DETECTION METHOD USING MULTIPLE VOICE CAPTURE DEVICES

(75) Inventors: Ying-Tsung Lin, Shinchu (TW); Yung-Chen Ting, Shinchu (TW); Pansop Kim, Shinchu (TW)

(73) Assignee: ISSC Technologies Corp., Shinchu (TW)

( * ) Notice: Subject to any disclaimer, the term of this patent is extended or adjusted under 35 U.S.C. 154(b) by 188 days.

(21) Appl. No.: 12/847,554

(22) Filed: Jul. 30, 2010

(65) Prior Publication Data

US 2011/0231186 A1 Sep. 22, 2011

(30) Foreign Application Priority Data

Mar. 17, 2010 (TW) ..... 99107897 A

(51) Int. Cl.
*G10L 11/02* (2006.01)

(52) U.S. Cl. ..... 704/233; 704/215

(58) Field of Classification Search ..... 704/215, 704/233, 237

See application file for complete search history.

(56) References Cited

U.S. PATENT DOCUMENTS

| | | | | |
|---|---|---|---|---|
| 4,696,039 | A * | 9/1987 | Doddington | 704/215 |
| 8,244,528 | B2 * | 8/2012 | Niemisto et al. | 704/233 |
| 8,249,862 | B1 * | 8/2012 | Cheng et al. | 704/205 |
| 2006/0133621 | A1 * | 6/2006 | Chen et al. | 381/92 |
| 2009/0089053 | A1 * | 4/2009 | Wang et al. | 704/233 |
| 2009/0111507 | A1 * | 4/2009 | Chen | 455/550.1 |
| 2010/0128881 | A1 * | 5/2010 | Petit et al. | 381/56 |
| 2011/0106533 | A1 * | 5/2011 | Yu | 704/233 |

* cited by examiner

*Primary Examiner* — James Wozniak
(74) *Attorney, Agent, or Firm* — Morris Manning & Martin LLP; Tim Tingkang Xia, Esq.

(57) ABSTRACT

A speech detection method is presented, which includes the following steps. A first voice captured device samples a first signal and a second voice captured device samples a second signal. The first voice captured device is closer to a speech signal source than the second voice captured device. A first energy corresponding to the first signal within an interval is calculated, a second energy corresponding to the second signal within the interval is calculated, and a first ratio is calculated according to the first energy and the second energy. The first ratio is transformed into a second ratio. A threshold value is set. It is determined whether the speech signal source is detected by comparing the second ratio and the threshold value.

5 Claims, 7 Drawing Sheets

SPEECH DETECTION METHOD USING MULTIPLE VOICE CAPTURE DEVICES

CROSS-REFERENCE TO RELATED APPLICATIONS

This non-provisional application claims priority under 35 U.S.C. §119(a) on Patent Application No(s). 099107897 filed in Taiwan, R.O.C. on Mar. 17, 2010, the entire contents of which are hereby incorporated by reference.

BACKGROUND

1. Field of Invention

The present invention relates to a speech detection method, and more particularly to a speech detection method in which duel voice captured devices are applied.

2. Related Art

In recent years, a hand-free speech communication system is widely used. Generally speaking, the hand-free speech communication system can be connected with a mobile communication device through a Bluetooth communication module. After digitization and modulation, the hand-free speech communication system can transform speech signals into individual packets. The packets are then transferred to a mobile communication module through the Bluetooth communication module.

However, in a practical environment, the hand-free speech communication system is interfered by environmental noises and definition of the original speech signal is decreased. For example, when a user uses a hand-free speech communication system by the side of a road with heavy traffic or in a subway station crowded by people, a microphone of the hand-free speech communication system receives various background noises. If a volume of the background noise is greater than a volume of the speech of the user, the background noise severely interferes with the speech signals sent by the user.

In addition, according to related researches on user behaviors, during the whole conversation, the speech of the user occupies less than half of the duration of the whole conversation. If in the duration of the whole conversation the hand-free speech communication system keeps transferring packets, unnecessary power consumption occurs to the hand-free speech communication system. As the hand-free speech communication system uses batteries to supply electric power, if unnecessary power consumption occurs continuously, the conversation duration or standby duration of the hand-free speech communication system is greatly reduced, so that the competitiveness of the hand-free speech communication system in the market is decreased.

SUMMARY

In view of the problems above, the present invention is a speech detection method, which is used for detecting a speech signal accurately when a user emits the speech signal.

The present invention provides a speech detection method, which comprises the following steps. A first voice captured device samples a first signal and a second voice captured device samples a second signal. The first voice captured device is closer to a speech signal source than a second voice captured device. A first energy corresponding to the first signal within an interval is calculated, a second energy corresponding to the second signal within the interval is calculated, and a first ratio is calculated according to the first energy and the second energy. The first ratio is transformed into a second ratio. A threshold value is set. It is determined whether the speech signal source is detected by comparing the second ratio and the threshold value.

The present invention further provides a speech detection method, which comprises the following steps. A first voice captured device samples a first signal and a second voice captured device samples a second signal. The first voice captured device is closer to a speech signal source than a second voice captured device. A speech energy determination step is performed to obtain a first determination result. A speech direction determination step is performed to obtain a second determination result. It is determined whether the speech signal source is detected according to the first determination result and the second determination result.

The speech energy determination step comprises the following steps. A first energy corresponding to the first signal within an interval is calculated, a second energy corresponding to the second signal within the interval is calculated, and a first ratio is calculated according to the first energy and the second energy. The first ratio is transformed into a second ratio. A threshold value is set. A first determination result is output by comparing the second ratio and the threshold value.

Also, the speech direction determination step comprises the following steps. A first correlation value in a first direction and a second correlation value in a second direction are calculated according to the first signal and the second signal. A second determination result is output according to the first correlation value and the second correlation value. The first direction is a direction corresponding to the speech signal source and the second direction is a direction except for the first direction.

According to the speech direction determination in the present invention, threshold value adjustment can be performed according to magnitude of the background environment noise, so as to increase the detection accuracy. In addition, auxiliary determination can be performed through the step of the speech direction, so as to further increase the detection accuracy.

BRIEF DESCRIPTION OF THE DRAWINGS

The present invention will become more fully understood from the detailed description given herein below for illustration only, and thus are not limitative of the present invention, and wherein.

DETAILED DESCRIPTION

The detailed features and advantages of the present invention are described below in great detail through the following embodiments. The content of the detailed description is sufficient for persons skilled in the art to understand the technical content of the present invention and to implement the present invention accordingly. Based upon the content of the specification, the claims, and the drawings, persons skilled in the art can easily understand the relevant objectives and advantages of the present invention.

Figure 1A:
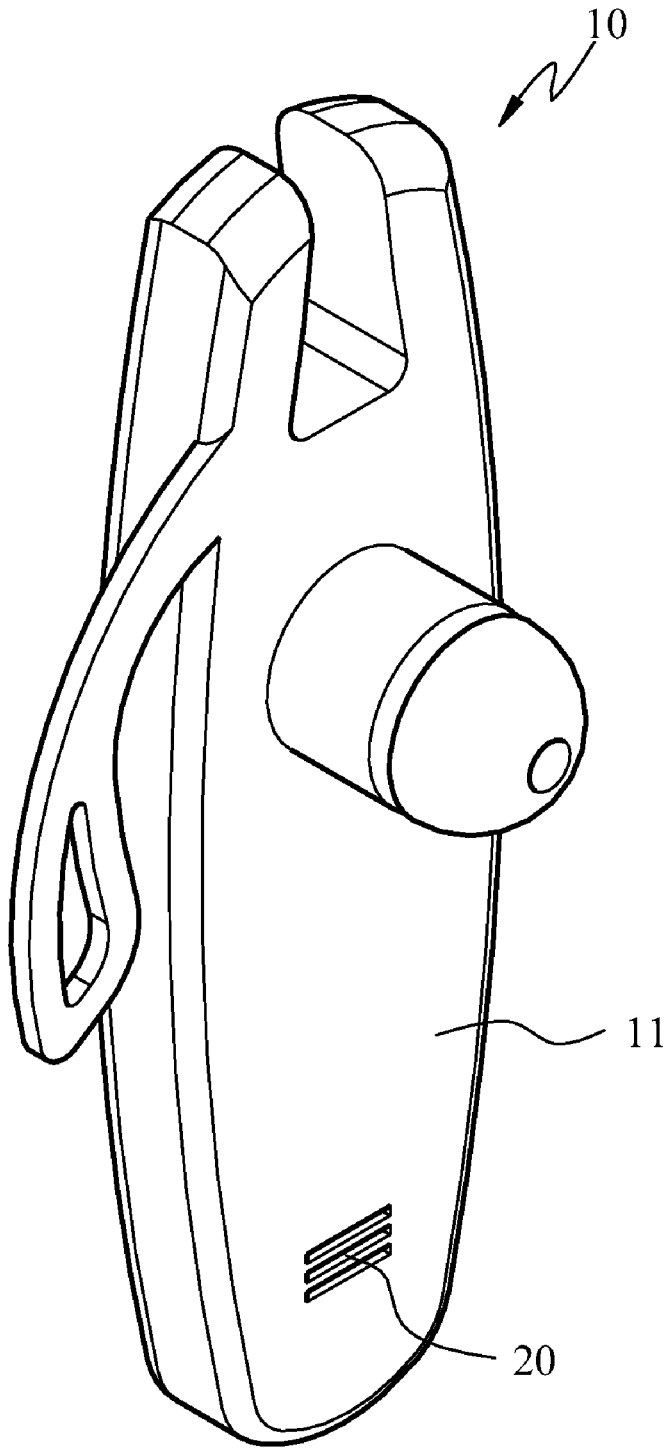
FIGS. 1A, 1B, and 1C are schematic appearance views of a hand-free speech communication system according to the present invention.
Figure 1B:
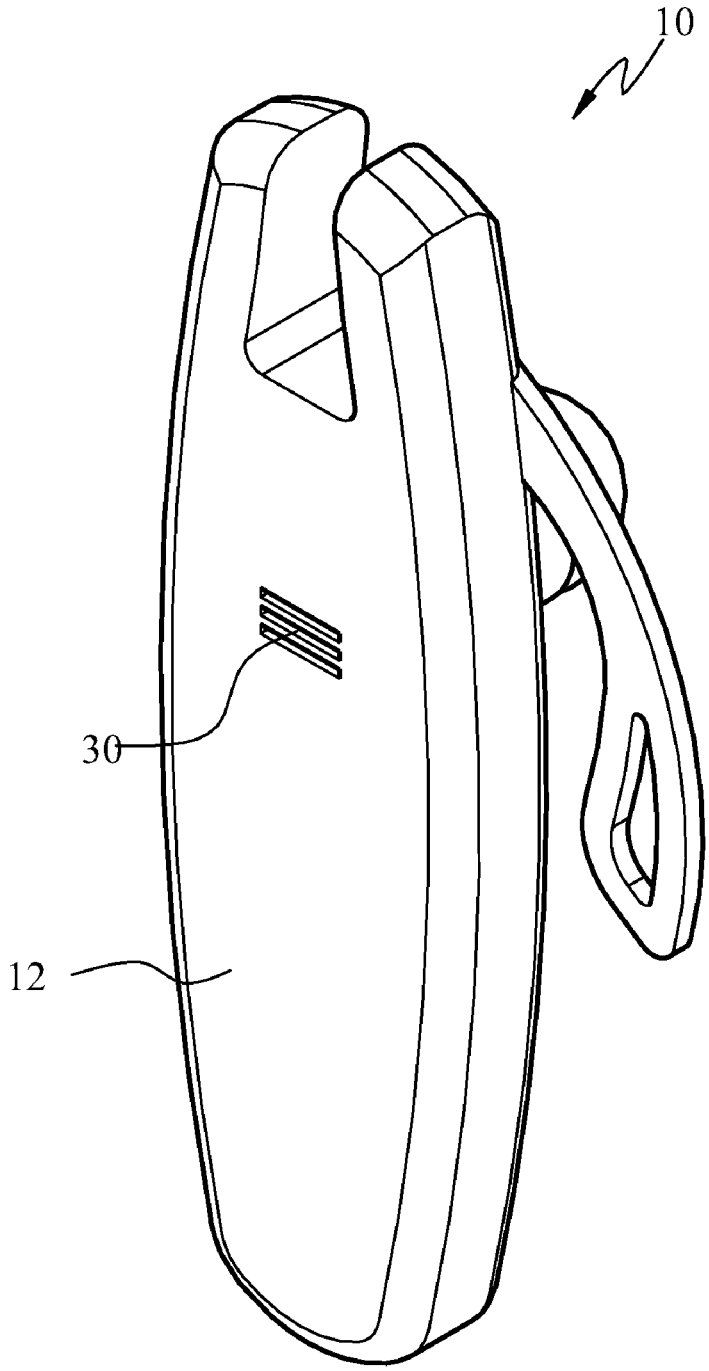
Figure 1C:
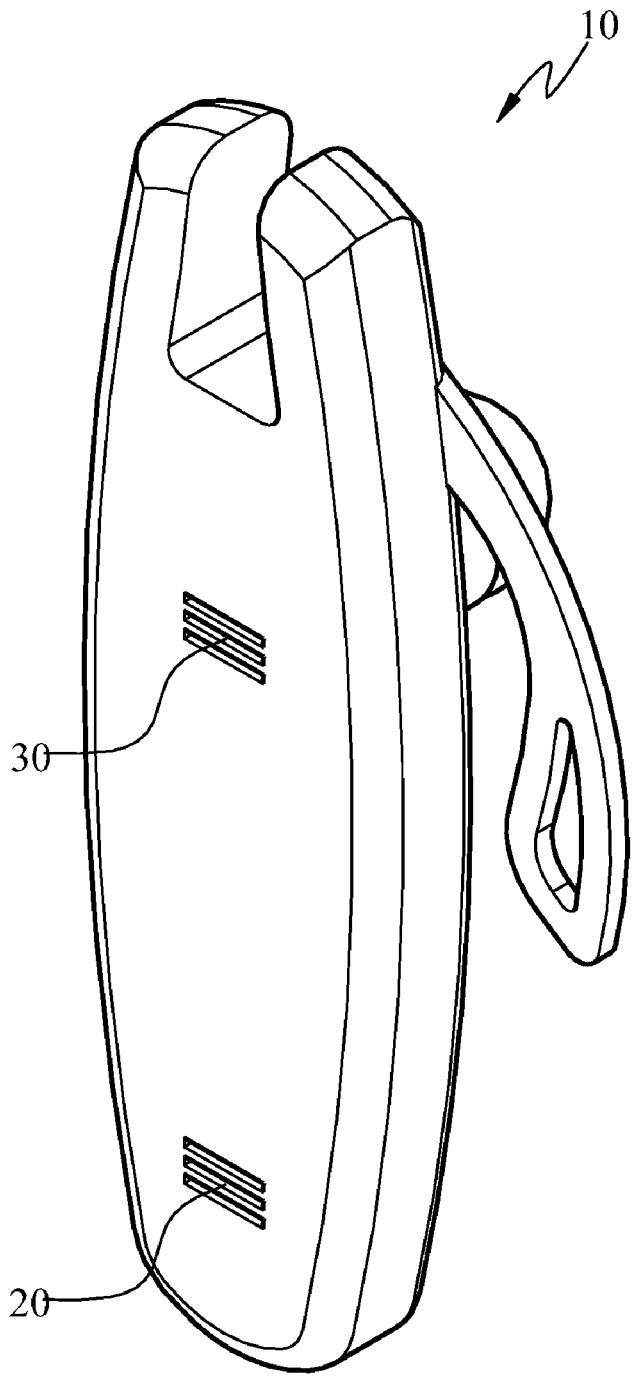

FIGS. 1A, 1B, and 1C are schematic appearance views of a hand-free speech communication system.

FIGS. 1A and 1B are schematic appearance view of a first embodiment. A hand-free speech communication system 10 comprises a first voice captured device 20 and a second voice captured device 30. The first voice captured device 20 and the second voice captured device 30 can be a microphone, respectively. The hand-free speech communication system 10 has a first side 11 and second side 12. When a user uses the hand-free speech communication system 10, the first side 11 is closer to the human face and the second side 12 is farther away from the human face. In this embodiment, the first voice captured device 20 is located at the first side 11 and the second voice captured device 30 is located at the second side 12. In addition, the first voice captured device 20 is closer to a speech signal source than the second voice captured device 30. The speech signal source is usually the month of the user.

FIG. 1C is a schematic appearance view of a second embodiment. A hand-free speech communication system 10 comprises a first voice captured device 20 and a second voice captured device 30. The hand-free speech communication system 10 comprises a first side 11 and a second side 12. When the user uses the hand-free speech communication system 10, the first side 11 is closer to the human face and the second side 12 is farther away from the human face. In this embodiment, both the first voice captured device 20 and the second voice captured device 30 are located at the first side 11. Also, the first voice captured device 20 is closer to a speech signal source than the second voice captured device 30. The speech signal source is usually the mouth of the user.

Figure 2:
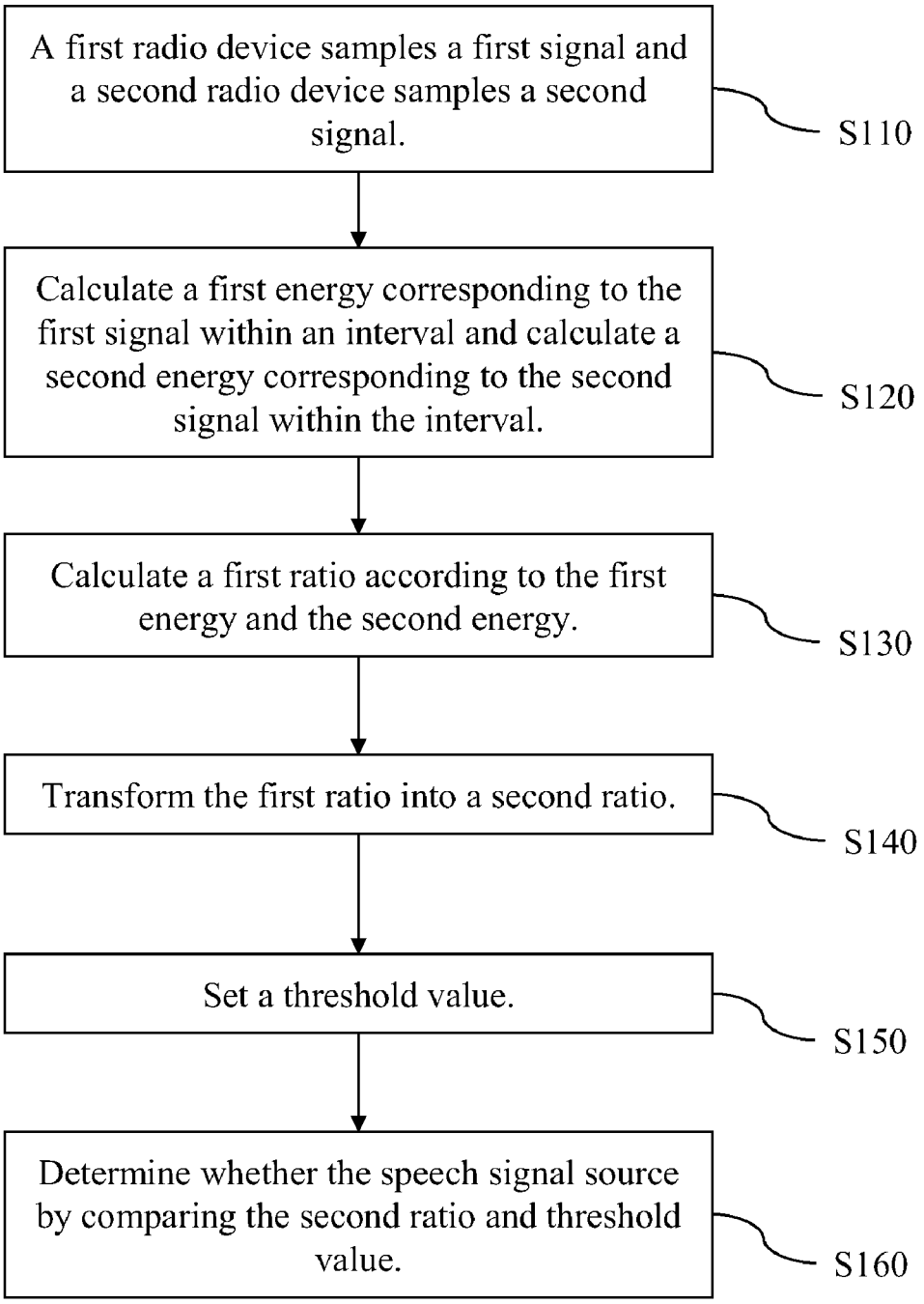
FIG. 2 is a flow chart of a speech detection method according to a first embodiment of the present invention.

FIG. 2 is a flow chart of a speech detection method according to a first embodiment of the present invention. The method is a speech energy determination process, which comprises the following steps. A first voice captured device samples a first signal and a second voice captured device samples a second signal (S110). A first energy corresponding to the first signal within an interval is calculated and a second energy corresponding to the second signal within the interval is calculated (S120). A first ratio is calculated according to the first energy and the second energy (S130). The first ratio is transformed into a second ratio (S140). A threshold value is set (S150). It is determined whether the speech signal source is detected by comparing the second ratio and threshold value (S160).

In Step S110, after a sound signal is captured, the first voice captured device 20 and the second voice captured device 30 perform periodic sampling and analog/digital transformation on the captured sound signals, the first voice captured device 20 outputs a first signal, and the second voice captured device 30 outputs a second signal. In this embodiment, a sampling frequency needs to be at least twice as much as the highest frequency of the speech signals. Generally speaking, the sampling frequency can be 8,000 Hz. If a better effect needs to be obtained, the sampling frequency can also be higher, such as 16,000 Hz or 32,000 Hz. Also, the analog/digital transformation can be 8-bit analog/digital transformation or higher, for example, 12-bit and 16-bit analog/digital transformation.

For convenience of illustration, the first signal is marked as P[t] and the second signal is marked as R[t]. The t is a positive integer, which represents a sequence in discrete time. For example, when the sampling frequency is 8,000 Hz and the sampling duration is one second, the t is a positive integer between 1 and 8000.

In Step S120, a method for calculating a first energy EP[n] of the first signal P[t] and a second energy ER[n] of the second signal R[t] within an interval is as follows:

$$EP[n] = \sum_{t=D^*(n-1)+1}^{D^*n} |P[t]|^2$$

$$ER[n] = \sum_{t=D^*(n-1)+1}^{D^*n} |R[t]|^2$$

The D is a length of the interval above. For example, the length of the interval is 64 sampling points, that is, D equals 64. In Step S120, the EP[1] is a sum of respective squares of P[1], P[2], . . . , and P[64] and the EP[2] is a sum of respective squares of P[65], P[66], . . . , and P[128]. Other values of the first energy can be obtained in the similar way. The calculation mode of the second energy is the same as that of the first energy.

The first energy EP[n] and the second energy ER[n] are operated in a time-domain. Further, the first energy EP[n] and the second energy ER[n] can also be operated in a frequency-domain. For operation in the frequency-domain, the signals P[1], P[2], . . . , and P[64] in the time-domain are transformed into signals P'[1], P'[2], . . . , and P'[64] in the frequency-domain through Fast Fourier Transformation (FFT). Similarly, the signals R[1], R[2], . . . , and R[64] in the time-domain are transformed into signals R'[1], R'[2], . . . , and R'[64] in the frequency-domain through the FFT.

Subsequently, the method below is used to calculate the first energy EP[n] and the second energy ER[n]:

$$EP[n] = \sum_{t=D^*(n-1)+1}^{D^*n} |P'[t]|^2$$

$$ER[n] = \sum_{t=D^*(n-1)+1}^{D^*n} |R'[t]|^2$$

In order to achieve a better detection effect, the signals P[t], R[t] in the time-domain or the signals P'[f], R[f] in the frequency-domain can be filtered by a low-pass filter to filter out a part of noise, and later the energy operation is performed thereon.

In Step S130, a first ratio D[n] is calculated according to the first energy EP[n] and the second energy ER[n]. The first ratio D[n] can be a result of dividing the second energy ER[n] by the first energy EP[n], that is, $$D[n] = \frac{ER[n]}{EP[n]}$$

When the user emits a speech signal, as the first voice captured device 20 is closer to the speech signal source than the second voice captured device 30 and the sound energy is in inverse ratio with a square of a transfer distance, theoretically, the first energy EP[n] is greater than the second energy ER[n]. That is to say, the D[n] is smaller than 1.

In Step S140, in order to obtain a smoother ratio, an exponential weighted moving average method can be used to transform the first ratio D[n] into a second ratio M[n]. The calculation method is as follows: $M[n]=(1-\alpha)xD[n]+\alpha xM[n-1]$, and $0\ \alpha<1$. When the $\alpha$ becomes greater, it represents that the second ratio M[n] becomes smoother. Generally speaking, $\alpha$ can be 0.99.

In Step S150, a threshold value Th[n] is set to determine whether the speech signal is detected. The threshold value Th[n] can be a constant value or adjusted dynamically with the second ratio M[n].

If the threshold value Th[n] is dynamically adjusted with the second ratio M[n], the adjustment can be performed according to the method below:

$$Th[n] = \beta \times \max_{t=1\sim n}\{M[t]\},$$

if;

$$Th[n] \le \beta \times \max_{t=1\sim n}\{M[t]\}$$

$$Th[n] = \sigma \times Th[n-1],$$

if;

$$Th[n] > \beta \times \max_{t=1\sim n}\{M[t]\}$$

$$\text{the } \max_{t=1\sim n}\{M[t]\}$$

is a regional maximum value, that is, a maximum value between the M[1] and M[n]. The β is a sensitivity constant and the σ is an attenuation constant. The β is a constant between 0 and 1. The greater β results in the greater threshold value Th[n]. Generally speaking, the β can be 0.5. The σ is a constant between 0 and 1, so that the threshold value Th[n] gradually decreases with time.

An objective of adjusting the threshold value Th[n] dynamically with the second ratio M[n] is enabling the threshold value Th[n] to change with the magnitude of the background noise. When the user is in an environment having large background noises, if the threshold value Th[n] is not adjusted higher accordingly, the speech signal is difficult to be detected. An objective of decreasing the threshold value Th[n] gradually is avoiding that a non-speech signal is easily detected as the threshold value Th[n] is kept at a very high value if the threshold value Th[n] is not decreased gradually when the background noises greatly decrease as the user moves into a very quiet environment from a very noisy environment.

Finally, in Step S160, by comparing the second ratio M[n] and the threshold value Th[n], it is determined whether the speech signal source is detected. When the second ratio M[n] is smaller than the threshold value Th[n], it represents that the speech signal is detected.

Figure 3A:
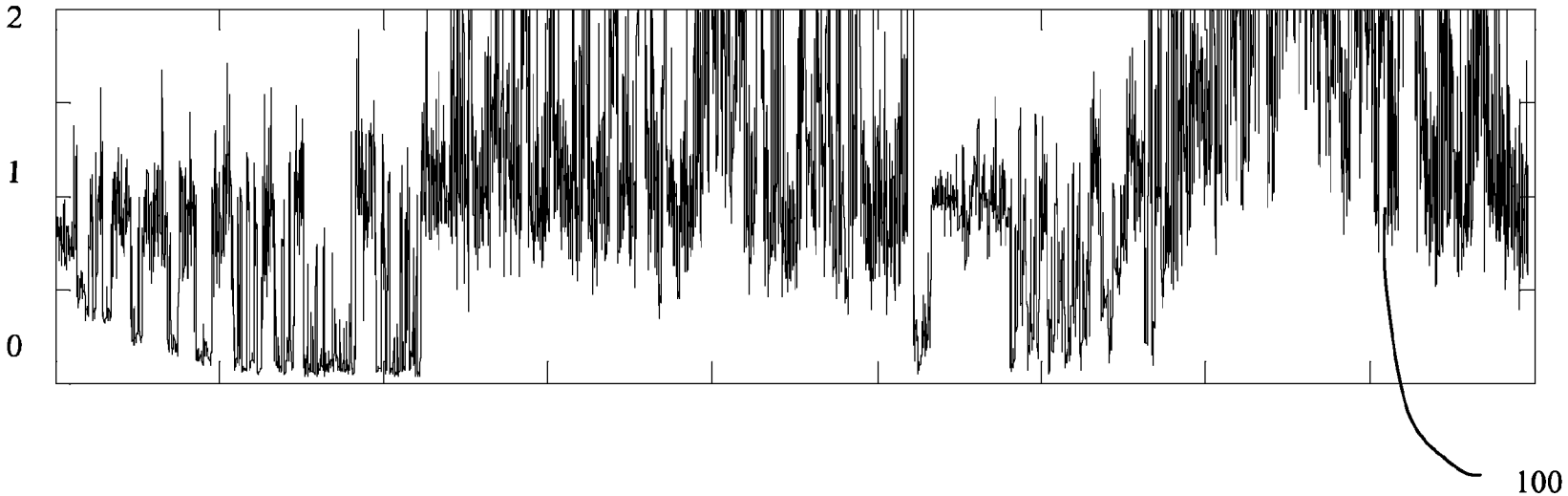
FIGS. 3A and 3B are simulating signal diagram according to the present invention.
Figure 3B:
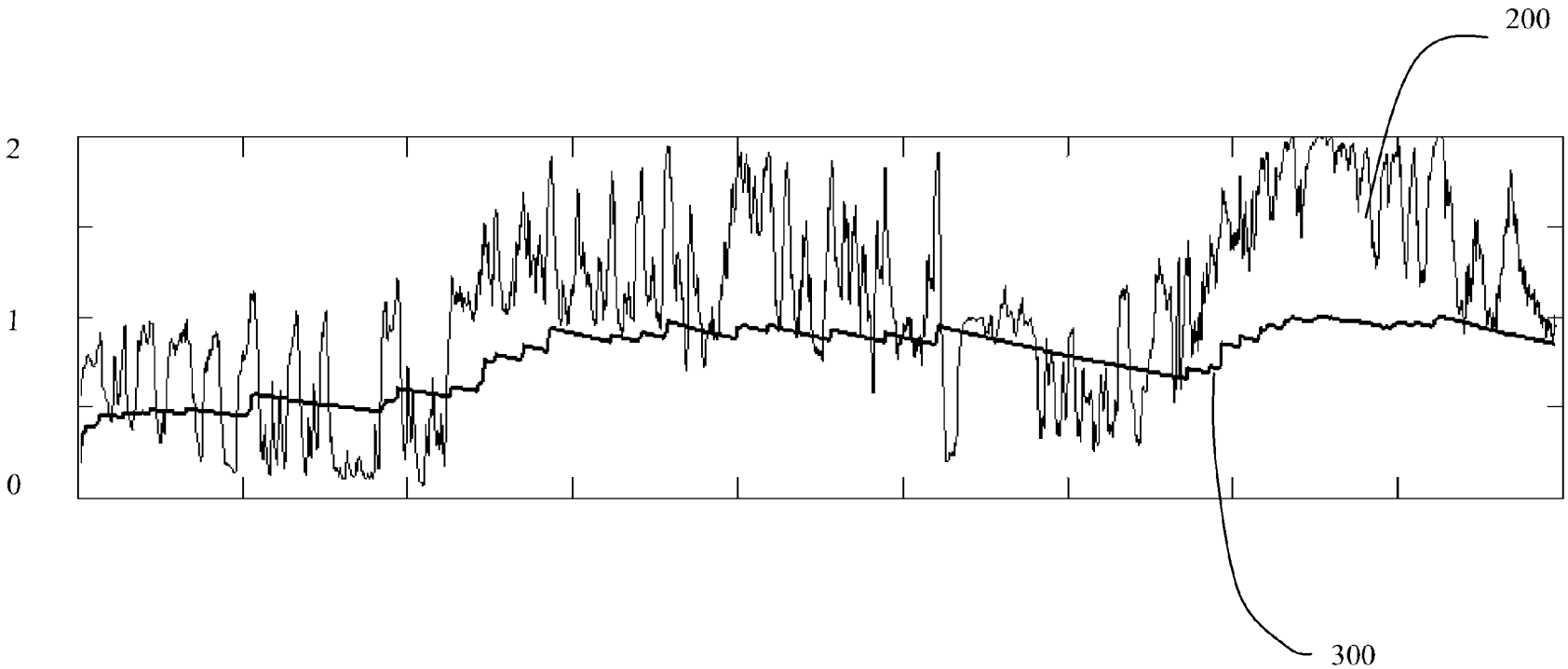

FIGS. 3A and 3B are simulating signal diagram. A line segment 100 in FIG. 3A represents the first ratio D[n]. As can be seen from FIG. 3A, the first ratio D[n] changes very fast. In FIG. 3B, a line segment 200 represents the second ratio M[n] and a line segment 300 represents the threshold value Th[n]. As can be seen from FIG. 3B, the second ratio M[n] changes much slower than the first ratio D[n]. Also, the threshold value Th[n] is dynamically adjusted with the second ratio M[n].

According to the method, two different voice captured devices can capture two different signals respectively. Also, after an energy ratio of the two different signals is calculated, a threshold value is set dynamically according to the energy ratio. Finally, it is then determined whether the speech signal is detected by comparing the threshold value and energy ratio. In such a manner, in the speech energy determination process according to the present invention, the threshold value can be adjusted according to the magnitude of the background environment noises, so as to increase the detection accuracy.

Figure 4:
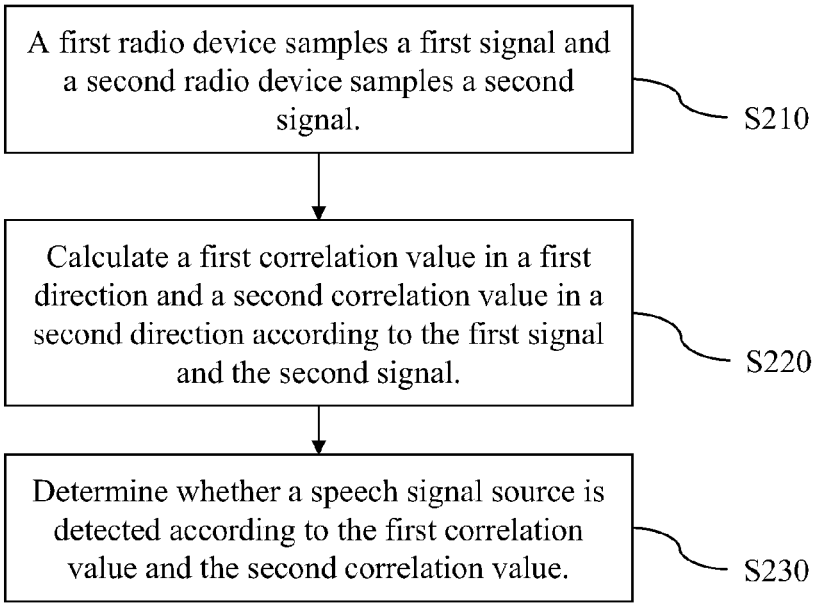
FIG. 4 is a flow chart of a speech detection method according to a second embodiment of the present invention.

In addition to the method above, the present invention further provides a speech direction determination process, so as to further increase the accuracy of speech determination. FIG. 4 is a flow chart of a speech detection method according to a second embodiment of the present invention. The speech direction determination process comprises the following steps. A first voice captured device samples a first signal and a second voice captured device samples a second signal (S210). A first correlation value in a first direction and a second correlation value in a second direction are calculated according to the first signal and the second signal (S220). It is determined whether a speech signal source is detected according to the first correlation value and the second correlation value (S230).

Step S210 is the same as Step S110, the description of which is omitted. Similarly, the first signal is marked as P[t] and the second signal is marked as R[t].

In Step S220, a calculation mode of the first correlation value C1[*t*] in the first direction is as follows: C1[*t*]=α×C1[*t*−1]+(1−α)×P[t−τ]×R[t]. The τ is a duration difference for the speech signal to reach the first voice captured device 20 and the second voice captured device 30 in the first direction. As the P[t] and R[t] are signals in discrete time after sampling, the τ should also be converted through the sampling frequency.

Figure 5:
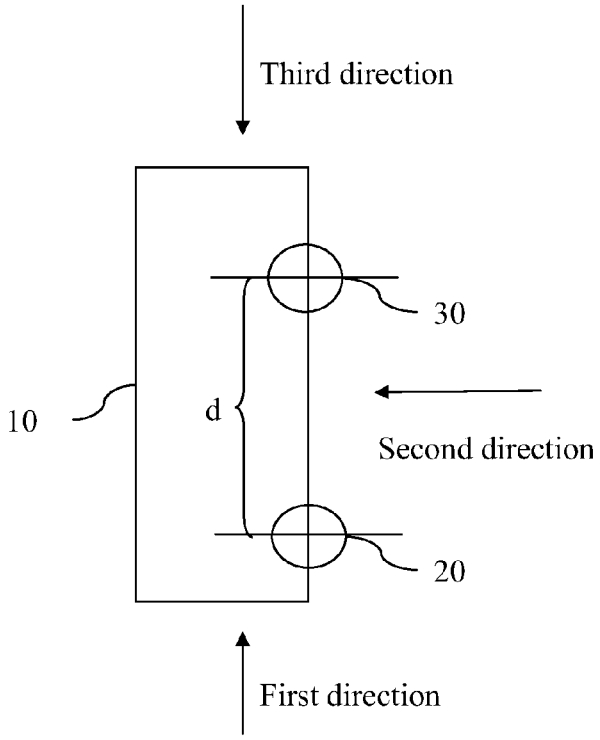
FIG. 5 is a side view of a hand-free speech communication system according to the present invention.

FIG. 5 is a side view of a hand-free speech communication system. A distance difference for the speech signal to reach the first voice captured device 20 and the second voice captured device 30 through the first direction is d centimeters. It is assumed that a sound wave travels at a velocity 33,000 (centimeters/second) at the room temperature. Therefore, a duration difference for the speech signal to reach the first voice captured device 20 and the second voice captured device 30 in the first direction is d/33,000 (second). Additionally, it is assumed that a sampling frequency for the first signal P[t] and second signal R[t] is 8,000 Hz, and thus it represents that a period of the sampling is 1/8000 second. Therefore, the duration difference τ is (d/33,000)/(1/8000) sampling points, that is, d×8/33 sampling points, after sampling frequency conversion. If the number of the sampling points calculated according to the expression above is not an integer, an adjacent integer can be taken according to the result obtained through the expression as the number of the sampling points.

Also, the calculation mode of the second correlation value C2[*t*] in the second direction is as follows: C2[*t*]=α×C2[*t*−1]+(1−α)×P[t]×R[t].

As the speech signal is emitted in the first direction, when the speech signal is emitted, the first correlation value C1[*t*] in the first direction is greater than the second correlation value C2[*t*] in the second direction. On the contrary, when the noise is emitted from the second direction, the second correlation value C2[*t*] in the second direction is greater than the first correlation value C1[*t*] in the first direction. Therefore, it can be determined whether the speech signal is detected by comparing the first correlation value C1[*t*] and the second correlation value C2[*t*].

In order to further increase the detection accuracy, in this step, a third correlation value C3[*t*] in a third direction can be further calculated. A calculation mode of the third correlation value C3[*t*] is as follows: C3[*t*]=α×C3[*t*−1]+(1−α)×P[t]×R[t−τ].

Subsequently, if the first correlation value C1[*t*] is greater than the second correlation value C2[*t*] and the first correlation value C1[*t*] is greater than the third correlation value C3[*t*], it is determined that the speech signal is detected. In order to further increase the speech detection accuracy, the determination expression above can be changed into that when the first correlation value C1[*t*] is greater than the second correlation value C2[*t*] added with the threshold value H and the first correlation value C1[$t$] is greater than the third correlation value C3[$t$] added with the threshold value H, it is determined that the speech signal is detected.

Both the speech energy determination process and the speech direction determination process above can be used as references for the determination. That is to say, when it is determined that the speech signal is detected in both the speech energy determination process and the speech direction determination process, it is finally determined that the speech signal is actually detected. Also, when it is determined that the speech signal is detected in one of the speech energy determination process or the speech direction determination process, it can be determined that the speech signal is detected.

The speech detection method above can be implemented in various methods. For example, the technology can be implemented in hardware, firmware, software or a combination thereof. A hardware embodiment can be one or more application-specific integrated circuits (ASIC), digital signal processors (DSP), programmable logic devices (PLD), field programmable gate arrays (FPGA), processors, controllers, micro-controllers, microprocessors, electric equipment, other electronic units designed to perform the functions described herein or processing units of a combination thereof.

For a firmware and/or software embodiment, program instructions can be used to implement the speech detection method disclosed in the present invention. For example, the program instructions can be stored in a memory and can be performed by a processor.

What is claimed is:

1. A speech detection method, comprising:

sampling a first signal by a first voice captured device, and sampling a second signal by a second voice captured device, wherein the first voice captured device is closer to a speech signal source than the second voice captured device;

calculating a first energy corresponding to the first signal within an interval, calculating a second energy corresponding to the second signal within the interval, and calculating a first ratio according to the first energy and the second energy;

transforming the first ratio into a second ratio by an exponential weighted moving average method;

setting a threshold value which is equal to a regional maximum value of the second ratio multiplied by a coefficient $\beta$ and then multiplied by an attenuation parameter $\sigma$, wherein $0<\beta\leqq 1$, and $0<\sigma\leqq 1$; and determining whether the speech signal source is detected by comparing the second ratio and the threshold value.

2. The speech detection method according to claim 1, wherein in the step of comparing the second ratio and the threshold value, if the second ratio is smaller than the threshold value, the speech signal source is detected.

3. A speech detection method, comprising:

sampling a first signal by a first voice captured device, and sampling a second signal by a second voice captured device, wherein the first voice captured device is closer to a speech signal source than the second voice captured device;

performing a speech energy determination step, comprising:

calculating a first energy corresponding to the first signal within an interval, calculating a second energy corresponding to the second signal within the interval, and calculating a first ratio according to the first energy and the second energy;

transforming the first ratio into a second ratio by an exponential weighted moving average method;

setting a threshold value which is equal to a regional maximum value of the second ratio multiplied by a coefficient $\beta$ and then multiplied by an attenuation parameter $\sigma$, wherein $0<\beta\leqq 1$, and $0<\sigma\leqq 1$; and outputting a first determination result by comparing the second ratio and the threshold value;

performing a speech direction determination step, comprising:

calculating a first correlation value in a first direction and a second correlation value in a second direction according to the first signal and the second signal, wherein the first direction is a direction corresponding to the speech signal source, and the second direction is a direction except for the first direction; and outputting a second determination result according to the first correlation value and the second correlation value; and determining whether the speech signal source is detected according to the first determination result and the second determination result.

4. The speech detection method according to claim 3, wherein in the step of determining whether the speech signal source is detected according to the first determination result and the second determination result, when the second ratio is smaller than the threshold value and the first correlation value is greater than the second correlation value, the speech signal source is detected.

5. The speech detection method according to claim 3, wherein in the step of determining whether the speech signal source is detected according to the first determination result and the second determination result, when the second ratio is smaller than the threshold value or the first correlation value is greater than the second correlation value, the speech signal source is detected.

* * * * *